US008282362B2

(12) United States Patent
Pardo

(10) Patent No.: US 8,282,362 B2
(45) Date of Patent: Oct. 9, 2012

(54) GAS COMPRESSOR

(76) Inventor: Herbert Pardo, Conyers, GA (US)

( * ) Notice: Subject to any disclaimer, the term of this patent is extended or adjusted under 35 U.S.C. 154(b) by 626 days.

(21) Appl. No.: 11/470,952

(22) Filed: Sep. 7, 2006

(65) Prior Publication Data

US 2007/0051088 A1 Mar. 8, 2007

Related U.S. Application Data

(60) Provisional application No. 60/714,718, filed on Sep. 7, 2005.

(51) Int. Cl.
*F04F 1/16* (2006.01)

(52) U.S. Cl. ..... 417/74

(58) Field of Classification Search ..... 417/73, 417/75, 53, 74; 123/657; 431/13, 24, 75
See application file for complete search history.

(56) References Cited

U.S. PATENT DOCUMENTS

| | | | | |
|---|---|---|---|---|
| 3,123,027 | A * | 3/1964 | Livingston | 110/189 |
| 4,385,489 | A * | 5/1983 | Abbott | 60/776 |
| 4,903,648 | A * | 2/1990 | Lassankse | 123/65 R |
| 6,289,666 | B1 * | 9/2001 | Ginter | 60/775 |
| 6,484,491 | B1 * | 11/2002 | Thordarson | 60/211 |

* cited by examiner

*Primary Examiner* — Devon Kramer
*Assistant Examiner* — Bryan Lettman
(74) *Attorney, Agent, or Firm* — Michael J. Bootcheck, LLC

(57) ABSTRACT

A power plant that outputs energy in the form of heated, compressed gas functions as a gas compressor, a motor, or a heater. The compression is accomplished by combusting a gas in a chamber and selectively diverting the high pressure exhaust to a container or conduit and selectively sealing the combustion chamber from the chamber when the chamber is reloaded with combustible gas.

8 Claims, 3 Drawing Sheets

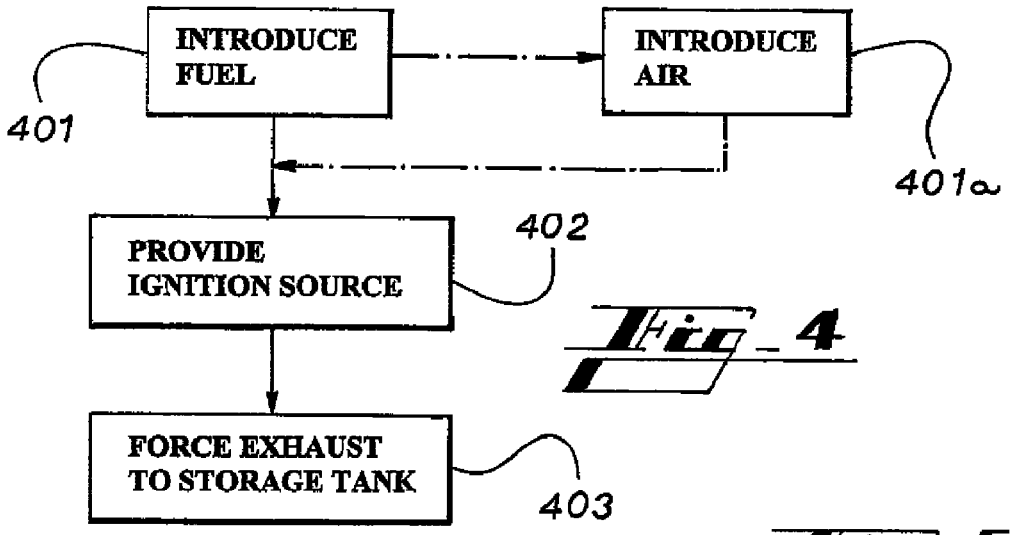
Fig. 4
Fig. 5
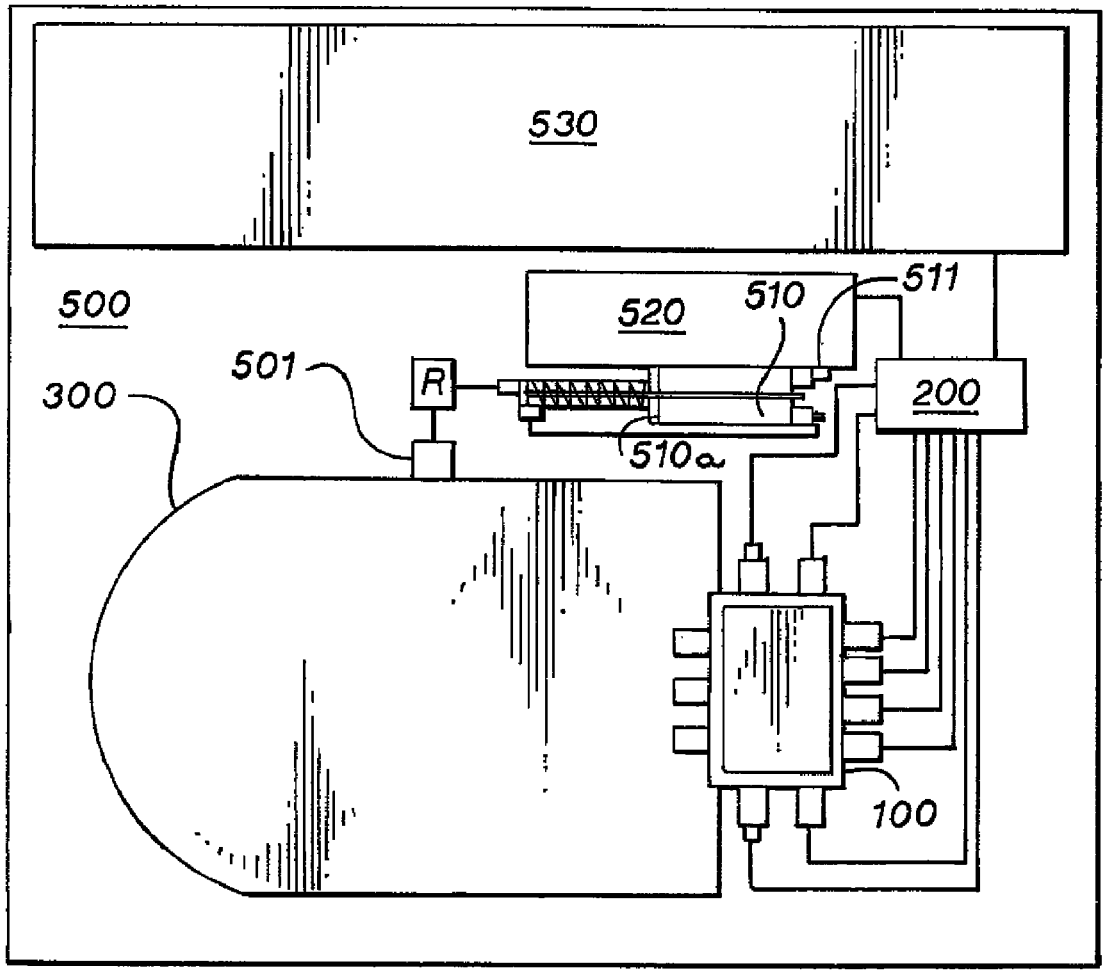

GAS COMPRESSOR

PRIORITY CLAIM TO RELATED APPLICATIONS

To the full extent permitted by law, the present non-provisional patent application claims priority to and the benefit of United States Provisional Patent Application entitled "Apparatus for Compressing Gas," filed on 7 Sep. 2005, having assigned Ser. No. 60/714,718.

BACKGROUND OF THE INVENTION

1. Technical Field

The present invention relates generally to power generation, and more particularly, to methods and systems for generating power through compressed gas.

2. Description of Related Art

A great number of modern devices rely on energy produced from one type of power plant or another—from coal, wind, or nuclear power plants to combustion engines to hydraulic or pneumatic pumps. Such systems are used to power modern devices through the generation of electricity or mechanical force. In numerous applications, it is advantageous for the system to output energy in the form of a mechanical force.

According to one such system, a combustion engine is used to burn fuel, which releases energy in the form of rapidly expanding gas. The gas expansion is used to drive a piston and, in turn, a shaft to which the piston is connected. The rotation of the shaft can be used to generate electricity through a generator, or can be mechanically coupled to a wheel or other tool.

Although such a system is capable of producing large amounts of power, the use of moving parts introduces inherent inefficiencies which increase the cost of using such a system to create electricity or mechanical force. In addition to introducing waste, the moving parts undergo wear and therefore require maintenance and eventual replacement, which further increases the cost of such a system. Finally, such systems require manufacture and assembly according to exacting specifications which increase the cost of the system and any replacement parts.

According to another such system, a boiler is used to burn fuel. The combustion of the fuel releases a large amount of energy in the form of heat. The heat is used to boil water, and thereby form steam. The steam is produced at high pressure, and is used to drive a turbine by allowing the high pressure steam to escape to a lower pressure environment, creating a fluid flow. The turbine converts the fluid flow into mechanical rotation of a shaft. The mechanical rotation of the shaft can be used to generate electricity through a generator, or can make use of mechanical force by direct attachment to a mechanical system, such as a flywheel.

While such a system has fewer moving parts than the combustion engine, the system depends on a supply of water to create steam. In a design where the steam is released to an external environment, a large supply of water is needed to replenish the water in the boiler as it is depleted. In an alternative design, the large water supply is eliminated by reclaiming the exhaust steam and condensing it back to water. The condenser system, however, introduces additional cost and complexity.

Therefore, it would be beneficial to provide a power plant that eliminates the problems described above by eliminating moving parts and by using a pneumatic fluid readily available from an external environment that is capable of outputting energy in an efficient manner.

BRIEF SUMMARY OF THE INVENTION

Briefly described, in a preferred embodiment, the present invention overcomes the above-mentioned disadvantages and meets the recognized need for such a device by providing a gas compressor comprising a sealed combustion chamber enclosing a fixed volume, an igniter coupled to the combustion chamber such that the igniter provides an ignition source to an interior of the combustion chamber, an input port in the combustion chamber, which input port selectively allows a fluid to flow into the interior of the combustion chamber, and an exhaust port in the combustion chamber, which exhaust port selectively allows a fluid to flow out of the interior of the combustion chamber.

The present invention further provides a method of compressing gas comprising opening an input port connected to a combustion chamber having a fixed interior volume, allowing fluid flow into an interior of the combustion chamber, introducing a combustible gas into the interior of the combustion chamber at a pressure above an atmospheric pressure outside the combustion chamber, closing the input port, preventing fluid flow out of the interior of the combustion chamber through the input port, providing an ignition source at the interior of the combustion chamber, igniting the combustible gas, opening an exhaust port connected to the combustion chamber, allowing fluid flow out of the interior of the combustion chamber through the exhaust port, and closing the exhaust port, preventing fluid flow into the interior of the combustion chamber through the exhaust port.

In a preferred embodiment, the method of the present invention further provides the steps of selectively opening at least one feedback port, allowing gas to flow out of the interior of the combustion chamber, determining characteristics of the gas in the interior of the combustion chamber by determining characteristics of gas that flows out of the interior of the combustion chamber through the feedback port, and controlling at least one of the introduction of the combustible gas into the interior of the combustion chamber, the ignition of the combustible gas in the interior of the combustion chamber, and the storage of the gas that flows out of the interior of the combustion chamber through the exhaust port.

These and other objects, features, and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which:

FIG. 4 is a flow chart illustrating the method of operation of the gas compressor of the present invention.

FIG. 5 is a schematic view of the configuration of FIG. 3 including additional components.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
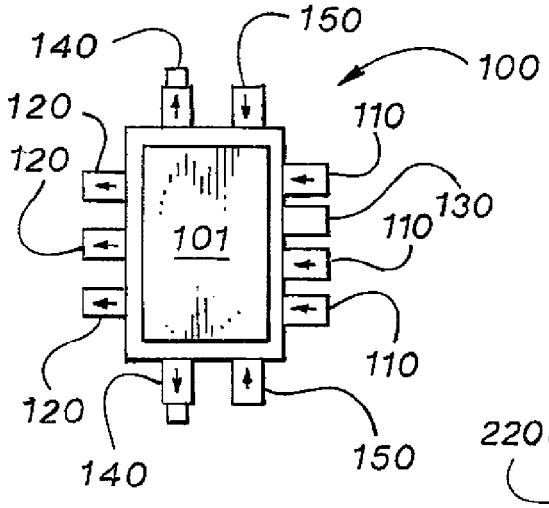
FIG. 1 is a schematic view of a gas compressor according to the present invention.

In that form of the preferred embodiment of the present invention chosen for purposes of illustration, FIG. 1 shows a gas compressor 100 defining an interior space 101 enclosed thereby, which interior space 101 functions as a combustion chamber. The interior space 101 has a fixed volume. The interior space 101 communicates with the outside of the gas compressor 100 by way of ports. Illustrated in FIG. 1 are fuel intake ports 110 and exhaust ports 120. Fuel intake ports 110 and exhaust ports 120 are preferably one way ports, which allow fluid flow in only one direction, as indicated by the arrows associated with each port, such as check valves or one-way valves. In this case, the fuel intake ports 110 and the exhaust ports 120 are preferably controllable to selectively allow fluid flow through the ports, either into or out of the gas compressor 100. Alternatively, at least one of each, or either, of the fuel intake ports 110 and the exhaust ports 120 could be a two way port, such as a two way valve, that is selectively controllable such that the fuel intake ports 110 only allow fluid flow into the gas compressor 100 and exhaust ports 120 only allow fluid flow out of the gas compressor 100. The selective control of the direction and amount of fluid flow through the fuel intake ports 110 and the exhaust ports 120 can be accomplished manually by conventional valve means, or automatically using mechanical means such as springs or servos or by using electromechanical means such as a solenoid.

Also shown in FIG. 1 is an igniter 130 attached to an exterior of the combustion chamber 100 and having at least a portion thereof in communication with the interior space 101. The igniter 130 provides an ignition source to the interior space 101 of the gas compressor 100. The ignition source can be a spark, similar to that supplied by an automotive spark plug, a heating element, similar to that provided by an automotive glow plug, or such ignition sources known to those skilled in the art.

FIG. 1 further illustrates feedback ports 140. Feedback ports 140 are a type of exhaust port, and serve to allow fluid to flow out of the interior space 101 of the gas compressor 100 so that characteristics of the gas within the interior space 101 of the gas compressor 100 can be determined. Characteristics of gas which can be determined include, for example, the temperature of the gas, the pressure of the gas either before or after combustion, and the chemical composition of the gas. The characteristics determined can be evaluated and used to control the functioning of the gas compressor 100 as will be described in more detail below.

In addition, FIG. 1 shows air intake ports 150. Air intake ports 150 are optional intake ports that can be used when fuel and air are mixed in the combustion chamber instead of at some other location at a time prior to delivery to the interior space 101. Another optional feature for fuel intake ports 110, feedback ports 140, and air intake ports 150 are filters (not shown) which can be included in a supply line connected to the port, attached directly to the port, or integrally included in the port.

Figure 2:
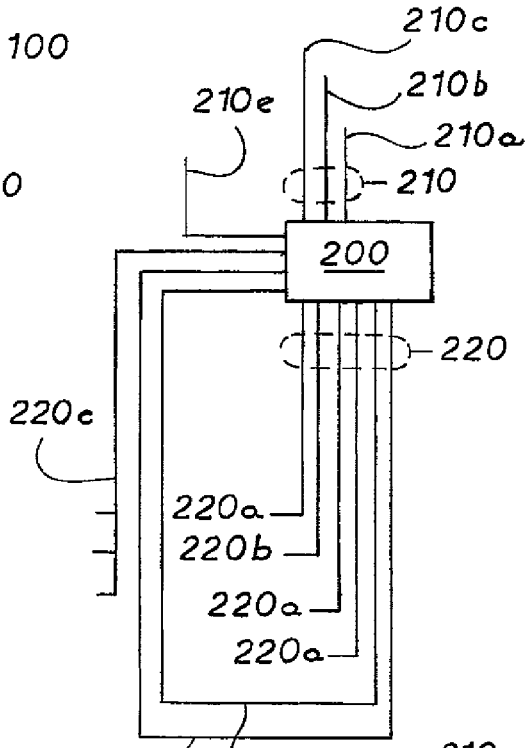
FIG. 2 is a schematic view of a control unit for use in association with the gas compressor of FIG. 1.

Referring now to FIG. 2, a control unit 200 is shown which can be used with the gas compressor 100 of FIG. 1. Control unit 200 has a plurality of inputs 210 and outputs 220. As shown in FIG. 2, input 210*a* is connected to a DC input, input 210*b* is connected to a fuel supply, an input 210*c* is connected to a fluid pressure source, an input 210*d* is connected to feedback ports 140, and input 210*e* is connected to an air supply. The DC input provides electrical power to the control unit which contains electrical circuitry including a processor. The DC power input further provides power so that the control unit can output electrical signals which can be used to operate mechanical servos or electromechanical controllers such as solenoids. The fuel supply can be any combustible fluid, such as an alcohol, and is preferably a combustible gas. The fluid pressure source is used to propel the fuel into the gas compressor, and can be a fuel pump. As described above, the feedback ports 140 allow selective determination of various characteristics of the gas within the gas within the interior space 101 of the gas compressor 100. Optionally, one or both feedback ports can be used to supply fluid pressure to drive a fuel pump, an air pump, a generator, or other device associated with the gas compressor 100.

Output 220*a* is connected to the fuel intake ports 110 and transmits fuel from the control unit to the fuel input ports 110 whereby fuel can be selectively introduced into the interior space 101 of the gas compressor 100. Optionally output 220*a* additionally carries air which is mixed with the fuel, such that output 220*a* provides an air and fuel mixture to intake ports 110. Output 220*b* is connected to the igniter 130 and provides a controllable electrical current to the igniter 130 to selectively operate the igniter 130 and ignite the fuel. Output 220*c* is connected to the output ports 120 and provides one of a pneumatic, hydraulic, or electric signal that opens or closes the exhaust ports 120. In this way, exhaust ports 120 can selectively be operated to allow fluid to flow out of the interior space 101 of the gas compressor 100. Additional outputs (not shown) can optionally be connected to fuel intake ports 110 to provide one of a pneumatic, hydraulic, or electric signal to selectively open and close fuel intake ports 110. In this way, a constant supply of pressurized fuel can by supplied to the fuel intake ports 110 and can be selectively introduced into the interior space 101 of the gas compressor 100. Output 220*d* is connected to air intake ports 150 and provides one of a pneumatic, hydraulic, or electric signal that selectively opens or closes air intake ports 150 to supply air to mix with fuel in the interior space 101.

Figure 3:
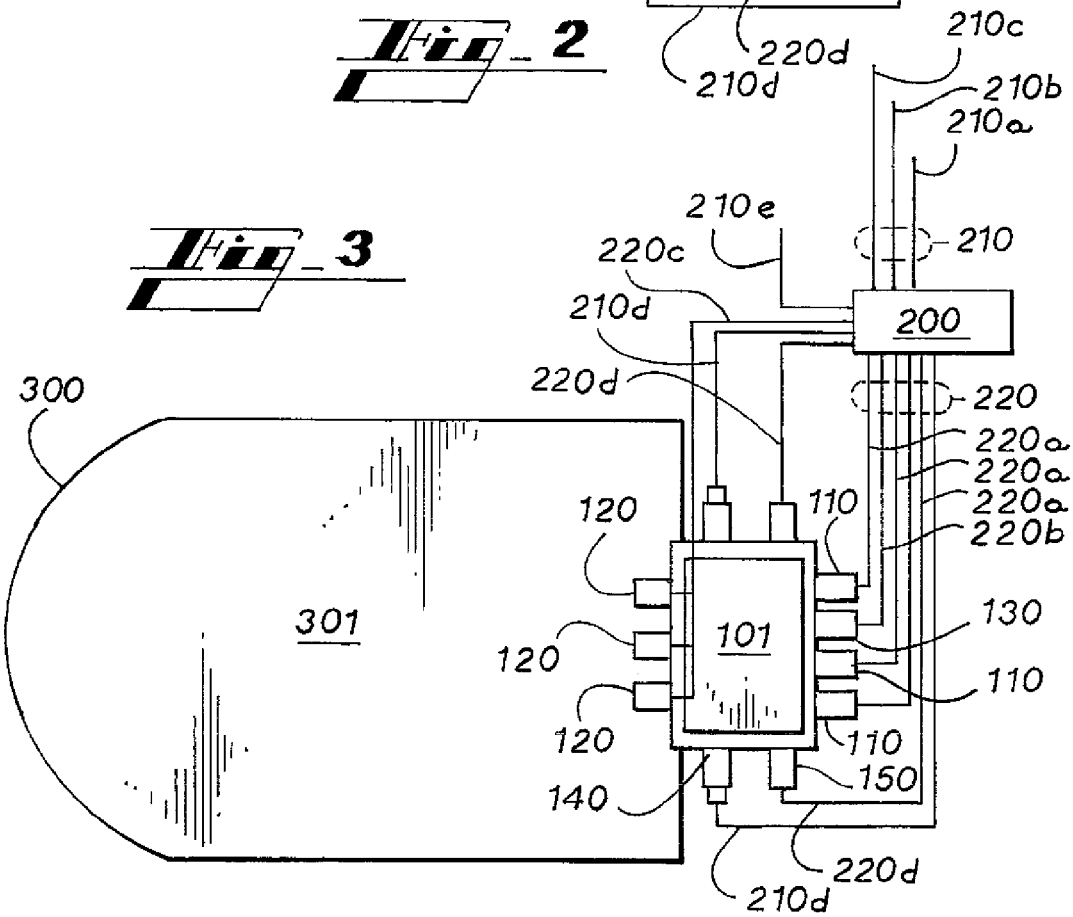
FIG. 3 a schematic view of the gas compressor of FIG. 1 in association with the control unit of FIG. 2 and connected to a storage tank.

Referring now to FIG. 3, the control unit 200 is connected to the gas combustor 100 of FIG. 1 as described above. In addition, storage tank 300 is shown connected to exhaust ports 120. Storage tank 300 is used to store high pressure and high temperature gas, which enters an interior space 301 of the storage tank 300 through the exhaust ports 120. For the purposes of this disclosure, high pressure is intended to mean any pressure higher than a prevailing atmospheric pressure of an environment in which gas compressor 100 is used, but is preferably between 10 and 300 PSI, and is more preferably between 50 and 200 PSI, and is most preferably between 80 and 150 PSI. Similarly, high pressure is intended to mean any temperature higher than a prevailing temperature of an environment in which gas compressor 100 is used, and is preferably between 30 and 4000 degrees Celsius, and is more preferably between 100 and 2000 degrees Celsius, and is most preferably between 150 and 500 degrees Celsius.

According to a preferred aspect of the invention, the gas compressor 100 is operated to the method illustrated in FIG. 4. In the first step 401, fuel is introduced into the interior space 101 of the gas compressor through the fuel intake ports 110. As described above, this step may optionally include the selective opening and/or closing of fuel intake ports 110, controlled by connections to the control unit 200. Step 401 may further include step 401*a*, introducing air into the interior space either through the air intake ports 150 or along with the fuel in an air and fuel mixture. In the second step 402, an ignition source is provided at the interior space 101 of the gas compressor 100 by the igniter 130. The ignition source ignites the fuel in the interior space 101 of the gas compressor 100, causing a release of energy in the form of heat, rapidly expanding the gas, causing an increase in fluid pressure in the interior space 101 of the gas compressor 100. The provision of the ignition source is optionally controlled by the control unit via a control signal, which in a preferred embodiment is an electronic control signal. In the third step 403, the high pressure in the interior space 101 of the gas compressor 100 forces the gas out the interior space 101 through the exhaust ports 120, and into the interior space 301 of the storage tank 300. Optionally, the exhaust ports 120 may be opened and/or closed by the control unit 200 via control signals.

In addition, one or more of exhaust ports 120 may be diverted from storage tank 300, and used to pressurize an air supply, a fuel supply, or both. One system for accomplishing such pressurization is illustrated in FIG. 5. According to the system, a gas exchanger 500 draws fluid pressure from storage tank 300 by way of valve 501 and fluid pressure regulator R and uses the fluid pressure to drive a piston 510*a*. Piston 510*a* travels in cylinder 510 forcing air through valve 511 and into air storage tank 520. Also shown in FIG. 5 is fuel storage tank 530 which may optionally be pressurized by a gas exchanger.

Figure 6:
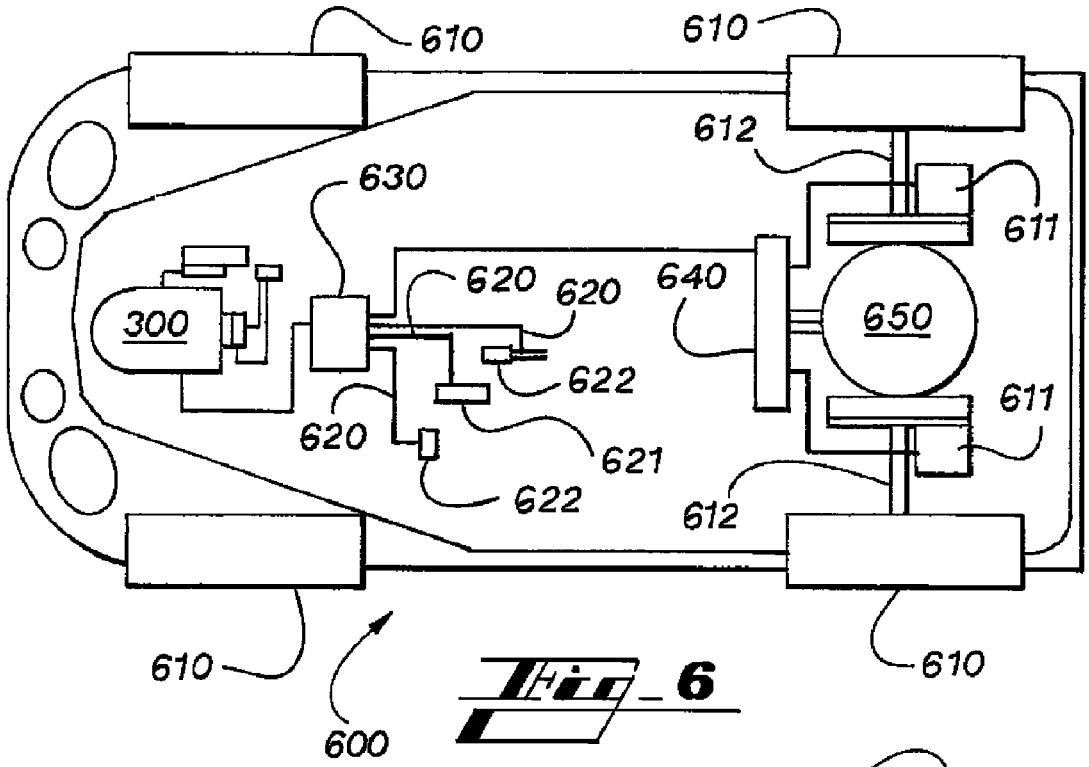
FIG. 6 is a plan view of a vehicle incorporating the configuration of FIG. 4 as a power plant.

By repetition of the steps described above, the storage tank can be filled with high pressure, high temperature gas. The storage tank containing the high temperature, high pressure gas can then be used in combination with various systems to provide mechanical, thermal, or electrical energy to the system. One such system is illustrated in FIG. 6. System 600 is a vehicle, such as an automobile or other vehicle. The system 600 comprises a plurality of wheels 610, at least one of which receives a rotational force to drive the vehicle. Preferably, the rotational force is applied to the wheels 610 by at least one drive motor 611 by way of a mechanical linkage 612. Additionally, the system includes a plurality of controls 620, such as an accelerator 621 and brakes 622. The controls 620 can be operated by a user to input control signals to the control unit 630. Control unit 630, additionally receives as an input, an output from the storage tank 300, preferably in the form of high pressure, high temperature gas. Control unit 630 can selectively distribute the output of the storage tank 300 to power the at least one drive motor 611. The drive motor can convert the high pressure, high temperature gas to the rotational force using a turbine, a piston, or other conventional means for converting fluid pressure to mechanical force. In a preferred embodiment, the system includes a return system which allows the gas to return from the drive motor 611 to the controller 200. The returned gas can be used to pressurize the fuel system or to drive an electric motor, thereby increasing the overall efficiency of the system.

Also shown in FIG. 6 is controller 640 which can optionally be included to further regulate the distribution of the output of the storage tank 300 to the at least one drive motor 611. The controller 640 may also be associated with sensors or other equipment for determining characteristics of the system 600. In a preferred embodiment, the system includes a flywheel 650 connected to at least one wheel 610 which receives the rotational force. In such an embodiment, controller 640 receives as inputs signals indicative of characteristics of the flywheel 650, such as rotational speed or rotational acceleration. The controller 640 transmits the signals indicative of characteristics of the flywheel to the control unit 630, which allows the control unit 630 to regulate distribution of the output from the storage tank 300 according to the inputs from the controls 620.

Figure 7:
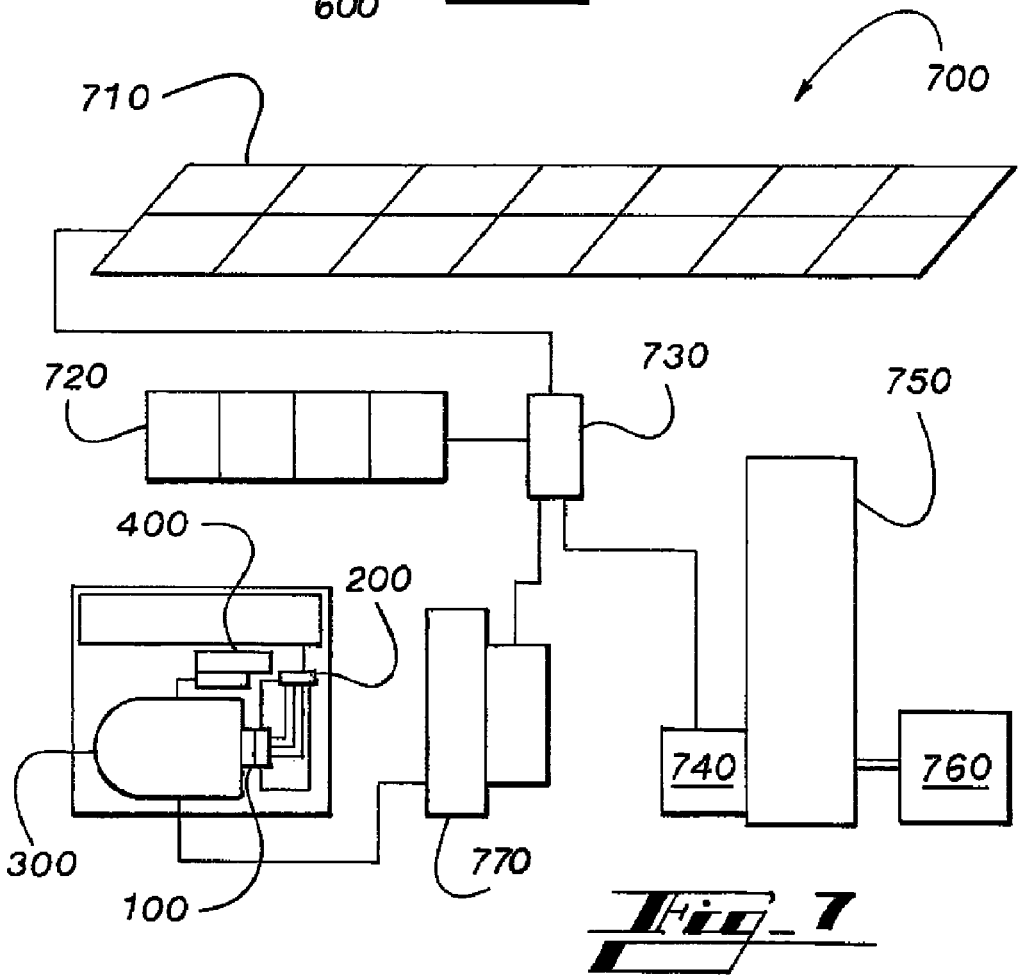
FIG. 7 is an alternative system incorporating the configuration of FIG. 4 as a power plant.

Referring now to FIG. 7, another system 700 is shown incorporating the gas compressor 100, control unit 200, storage tank 300, and gas exchanger 400. System 700 comprises a solar panel 710, batteries 720, control unit 730, motor 740, flywheel 750, AC generator 760, and pneumatic generator 770. System 700 provides an AC power source as an output of AC generator 760, which can be used to provide power where it is needed, such as at a remote location where other sources of AC power are not available, or can be used as a back-up system providing power when a primary AC power source fails. AC generator 760 is mechanically driven by flywheel 750 which stores angular momentum to and acts as a reservoir of mechanical energy to ensure a consistent amount of mechanical force is provided to drive the AC generator 760. Flywheel 750 is driven by motor 740 which is preferably a DC electric motor. Power to drive motor 740 is selectively provided by control unit 730 which can monitor characteristics of the flywheel or the load on the AC generator to determine when to supply power to motor 740. Control unit 730 derives power from multiple sources, such as solar panel 710, batteries 720, and pneumatic generator 770. The pneumatic generator outputs DC power by using fluid pressure supplied by the storage tank 300.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is at least:

1. A method of compressing gas comprising:

opening an input port connected to a combustion chamber having a fixed interior volume, allowing fluid flow from a fuel tank into an interior of the combustion chamber;

introducing a combustible gas into the interior of the combustion chamber at a pressure above an atmospheric pressure outside the combustion chamber;

closing the input port, preventing fluid flow out of the interior of the combustion chamber through the input port;

providing an ignition source at the interior of the combustion chamber, igniting the combustible gas;

opening an exhaust port connected to the combustion chamber, allowing fluid flow out of the interior of the combustion chamber through the exhaust port;

closing the exhaust port, preventing fluid flow into the interior of the combustion chamber through the exhaust port;

monitoring chemical characteristics of the fluid within the combustion chamber through feedback ports in communication with the combustion chamber; and storing at least a portion of the fluid coming out of the exhaust port in a storage tank configured to store high pressure fluid wherein the storage tank only communicates with the fuel tank through the combustion chamber.

2. The method of claim 1, wherein each of the input port and the exhaust port allow fluid flow in only one direction, the input port allowing fluid to flow into the interior of the combustion chamber, and the exhaust port allowing fluid to flow out of the interior of the combustion chamber.

3. The method of claim 1, further comprising the steps of:

selectively opening at least one of the feedback ports, allowing gas to flow out of the interior of the combustion chamber;

determining the characteristics of the gas in the interior of the combustion chamber by determining the characteristics of the gas that flows out of the interior of the combustion chamber through the at least one feedback port; and controlling at least one of the introduction of the combustible gas into the interior of the combustion chamber, the ignition of the combustible gas in the interior of the combustion chamber, and the storage of the gas that flows out of the interior of the combustion chamber through the exhaust port.

4. The method of claim 1, further comprising transferring at least a portion of the fluid stored to pressurize an air storage tank.

5. A method of compressing gas comprising:

opening an input port connected to a combustion chamber having a fixed interior volume, allowing fluid flow from a fuel tank into an interior of the combustion chamber;

introducing a combustible gas into the interior of the combustion chamber at a pressure above an atmospheric pressure outside the combustion chamber;

closing the input port, preventing fluid flow out of the interior of the combustion chamber through the input port;

providing an ignition source at the interior of the combustion chamber, igniting the combustible gas;

opening an exhaust port connected to the combustion chamber, allowing fluid flow out of the interior of the combustion chamber through the exhaust port;

closing the exhaust port, preventing fluid flow into the interior of the combustion chamber through the exhaust port;

monitoring thermal characteristics of the fluid within the combustion chamber through feedback ports in communication with the combustion chamber; and storing at least a portion of the fluid coming out of the exhaust port in a storage tank configured to store high pressure fluid wherein the storage tank only communicates with the fuel tank through the combustion chamber.

6. The method of claim 5, wherein each of the input port and the exhaust port allow fluid flow in only one direction, the input port allowing fluid to flow into the interior of the combustion chamber, and the exhaust port allowing fluid to flow out of the interior of the combustion chamber.

7. The method of claim 5, further comprising the steps of:

selectively opening at least one of the feedback ports, allowing gas to flow out of the interior of the combustion chamber;

determining the characteristics of the gas in the interior of the combustion chamber by determining the characteristics of the gas that flows out of the interior of the combustion chamber through the at least one feedback port; and controlling at least one of the introduction of the combustible gas into the interior of the combustion chamber, the ignition of the combustible gas in the interior of the combustion chamber, and the storage of the gas that flows out of the interior of the combustion chamber through the exhaust port.

8. The method of claim 5, further comprising transferring at least a portion of the fluid stored to pressurize an air storage tank.

* * * * *